US006109935A

United States Patent [19]

Yang

[11] Patent Number: 6,109,935

[45] **Date of Patent: *Aug. 29, 2000**

[54] VERTICAL-TYPE ELECTRICAL CONNECTOR AND TERMINALS THEREFOR

[75] Inventor: Tzung-Lin Yang, Taipei, Taiwan

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/079,099

[22] Filed: May 14, 1998

[30] Foreign Application Priority Data

May 16, 1997 [CH] Switzerland ..... 86207971

[51] Int. Cl.[7] ..... H01R 9/09

[52] U.S. Cl. ..... 439/80

[58] Field of Search ..... 439/79, 607, 609, 439/80

[56] References Cited

U.S. PATENT DOCUMENTS

| | | | |
|---|---|---|---|
| 4,210,376 | 7/1980 | Hughes et al. . | |
| 4,666,231 | 5/1987 | Sheesley et al. . | |
| 4,908,335 | 3/1990 | Cosmos et al. | 439/79 |
| 5,100,344 | 3/1992 | Truong | 439/578 |
| 5,186,633 | 2/1993 | Mosser, III | 439/79 |
| 5,221,212 | 6/1993 | Davis | 439/108 |
| 5,725,386 | 3/1998 | Davis et al. | 439/79 |
| 5,779,489 | 7/1998 | Davis et al. | 439/79 |

*Primary Examiner*—Steven L. Stephan
*Assistant Examiner*—J. F. Duverne
*Attorney, Agent, or Firm*—Charles S. Cohen

[57] ABSTRACT

An electrical connector has a terminal housing that includes a central body, a terminal support plate, and a tail aligning plate. The body is formed with a plurality of terminal openings. The terminal support plate extends forwardly from the back plate, and is provided with a plurality of horizontally extending terminal cavities that are vertically aligned and that are normal to the body. The terminal cavities correspond respectively to the terminal openings. The tail aligning plate extends rearwardly from the body, and is provided with a plurality of notches that form a horizontal array parallel to the body. Each of a plurality of terminals includes a vertical solder tail portion retained in a respective one of the notches, a horizontal terminal mating portion received in a respective one of the terminal cavities, and a retention portion between the solder tail portion and the terminal mating portion and engaging the back plate in a respective one of the terminal openings.

17 Claims, 8 Drawing Sheets

VERTICAL-TYPE ELECTRICAL CONNECTOR AND TERMINALS THEREFOR

BACKGROUND OF THE INVENTION

The invention relates to electrical connectors, more particularly to a vertical-type electrical connector and terminals therefor, the terminals having vertical solder tail portions that form a single row parallel to a vertical back plate of a terminal housing.

Universal Serial Bus (USB) connectors are commonly employed in the computer industry for signal transmission purposes. Referring to FIG. 1, a conventional USB connector set, such as a vertical-type electrical connector set, is shown to comprise a socket 1 and a plug 2 connected to the socket 1 for data transmission. The socket 1 generally comprises a terminal housing 11 having terminals 111 mounted thereon, and a shell 12 for enclosing the terminal housing 11. The shell 12 is formed by punching a conductive plate to form a rectangular shell body, and has an open front end 121 for insertion of the plug 2. Referring to FIG. 2, the terminal housing 11 is formed with four L-shaped terminal cavities in vertical plane thereof. Particularly, the terminal housing 11 has four horizontal terminal contact cavity portions 11*a* that are vertically aligned, and four vertical solder tail cavity portions 11*b* that extend from a respective one of the terminal contact cavity portions 11*a* and that are horizontally aligned in a longitudinal direction of the terminal housing 11. Each of the four terminals 111 is generally L-shaped, and has a terminal contact section 111*a* disposed in a respective one of the terminal contact cavity portions 11*a*, and a solder tail section 111*b* disposed in the corresponding one of the solder tail cavity portions 11*b*.

The drawbacks of the conventional USB connector set are as follows: the solder tail cavity portions 11*b* are horizontally aligned in a longitudinal direction of the terminal housing 11. In order to keep an appropriate distance between adjacent solder tail sections 111*b* disposed in the solder tail cavity portions 11*b* to minimize signal interference there among and maintain good signal transmission quality, adjacent ones of the solder tail cavity portions 11*b* must have a fixed distance therebetween. Moreover, in order to align vertically the terminal contact sections 111*a* and to align horizontally the solder tail sections 111*b*, the terminal 111 with the uppermost one of the terminal contact sections 111*a* must be longer than the other terminals 111. Thus, the terminal housing 11 has a relatively long length in the longitudinal direction (about 20–22 mm). Accordingly, there is a corresponding increase in the size of the shell 12 that covers the terminal housing 11. The configuration as such results in a relatively long USB connector socket that occupies more real estate on a circuit board.

SUMMARY OF THE INVENTION

Therefore, the object of the present invention is to provide an electrical connector that occupies less real estate when mounted on a circuit board.

Particularly, the main object of the present invention is to provide a vertical-type electrical connector having terminals mounted on a terminal housing such that solder tail portions of the terminals form a single row parallel to a vertical back plate of the terminal housing.

Another object of the present invention is to provide conductive terminals to be mounted on a terminal housing of an electrical connector, wherein solder tail portions of the conductive terminals can form a single row parallel to a vertical back plate of the terminal housing.

According to a first aspect of the invention, an electrical connector comprises a terminal housing and a plurality of terminals.

The terminal housing includes a central body having a front surface and a back surface, a terminal support plate, and a tail aligning plate. The central body is formed with a plurality of terminal openings. The terminal support plate extends forwardly from the front surface of the body, and is provided with a plurality of horizontally extending terminal cavities that are vertically arrayed and that are normal to the front surface of the body. The terminal cavities correspond respectively to the terminal openings. The tail aligning plate extends rearwardly from the back surface of the body, and is provided with a plurality of notches that form a horizontal array parallel to the back surface of the body.

Each of the terminals includes a vertical solder tail portion retained in a respective one of the notches, a horizontal terminal mating portion received in a respective one of the terminal cavities, and a retention portion between the solder tail portion and the terminal mating portion and engaging the body in a respective one of the terminal openings.

According to a second aspect of the invention, a conductive terminal for an electrical connector comprises a vertical solder tail portion, a horizontal terminal mating portion, and a retention portion between the solder tail portion and the terminal mating portion. The retention portion includes a horizontal plate section and a vertical plate section extending from the horizontal plate section. The solder tail portion has a top edge connected to a rear edge of the horizontal plate section. The terminal mating portion has a rear edge connected to a front edge of the vertical plate section.

Preferably, the terminal mating portion includes a bent resilient contact strip, and an offset extension that interconnects the retention portion and the resilient contact strip.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
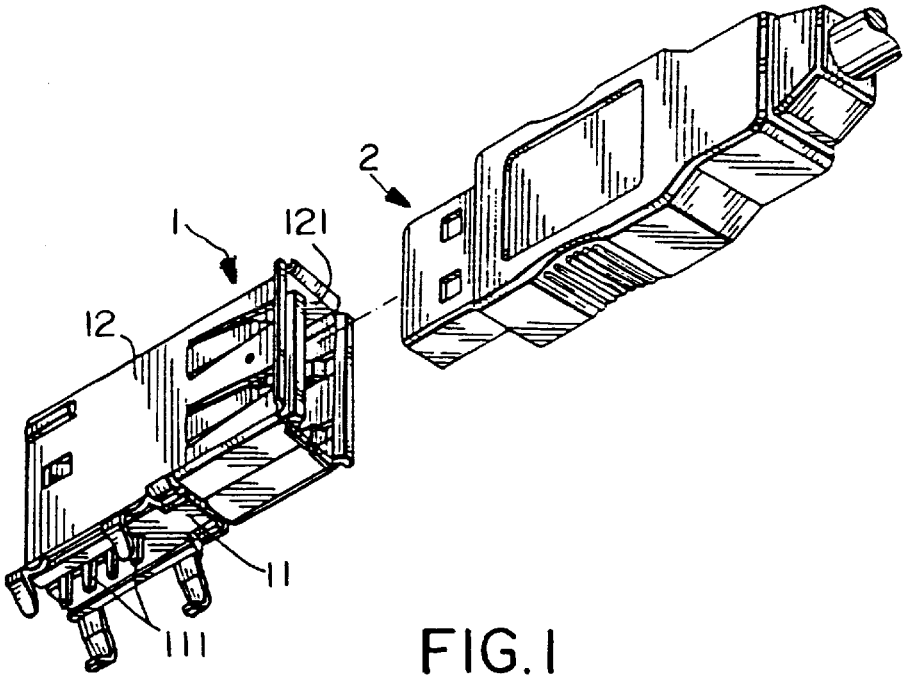
FIG. 1 PRIOR ART
FIG. 1 is a perspective view illustrating a socket and a plug of a conventional USB electrical connector.
Figure 2:
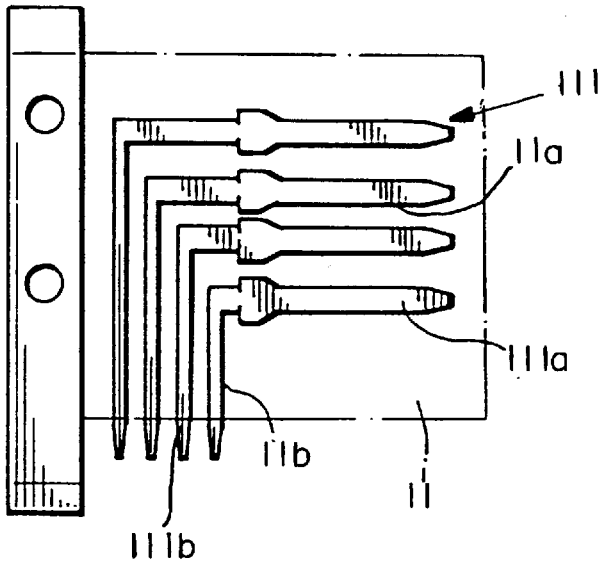
FIG. 2 PRIOR ART
FIG. 2 is a schematic view illustrating how terminals are arranged in the socket of the conventional USB electrical connector shown in FIG. 1.
Figure 3:
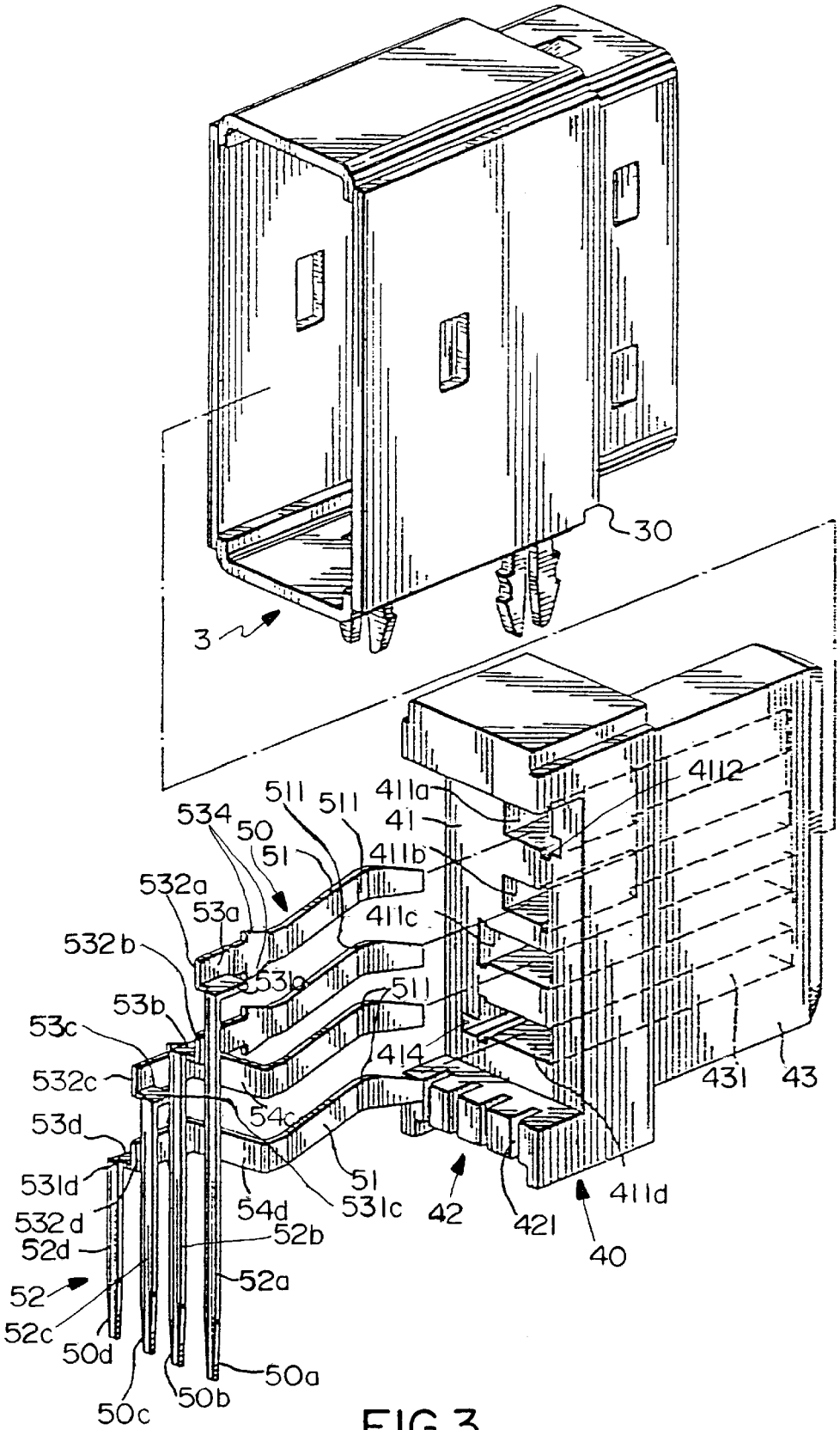
FIG. 3 is an exploded perspective view of the first preferred embodiment of a vertical-type electrical connector according to this invention.

Before the present invention is described in greater detail, it should be noted that like elements are denoted by the same reference numerals throughout the disclosure.

Referring to FIGS. 3, 4, 5 and 6, the first preferred embodiment of a vertical-type electrical connector according to the present invention is shown to be in the form of a USB connector socket 3 that includes a terminal housing 40, a terminal set 50 mounted on the terminal housing 40, and a conductive shell 30 for enclosing the terminal housing 40.

The terminal housing 40 is formed integrally from an insulator material, and includes a central body preferably in the form of a vertical back plate 41, a vertical terminal support plate 43 that extends forwardly from the back plate 41, and a horizontal tail aligning plate 42 that extends rearwardly from the back plate 41.

Figure 4:
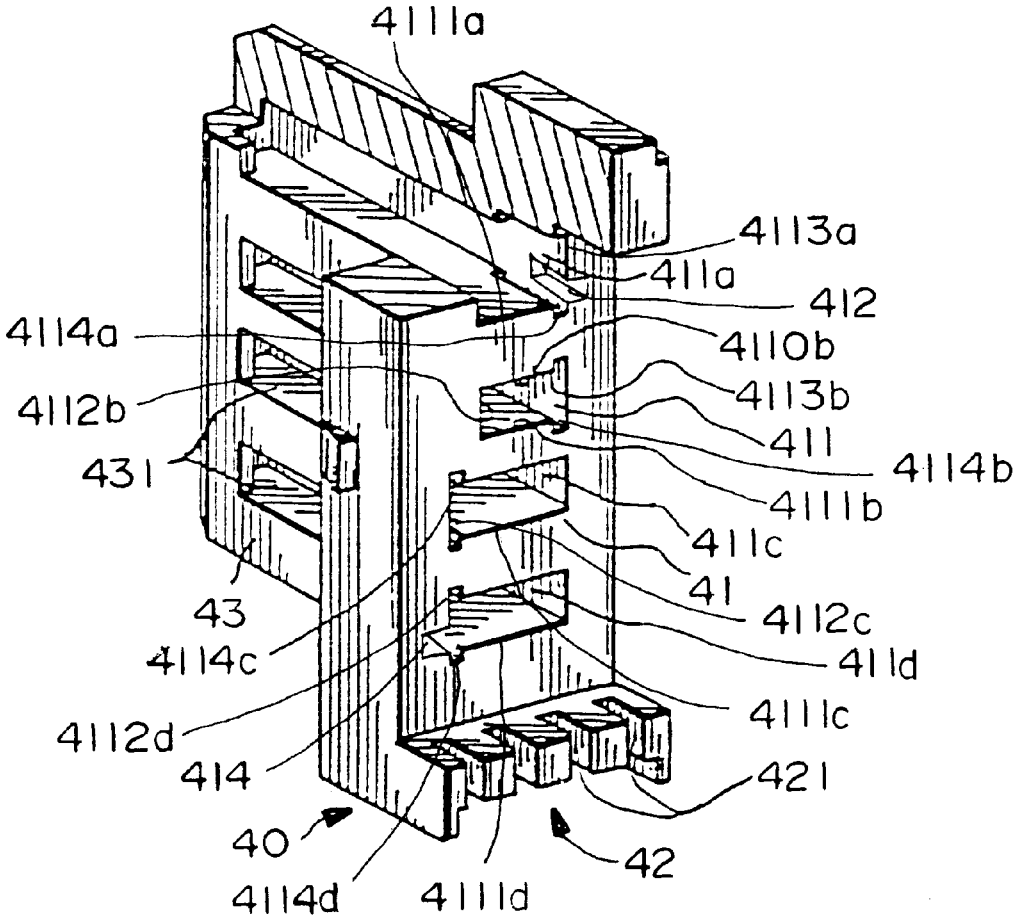
FIG. 4 is a perspective, partly sectional view of a terminal housing of the first preferred embodiment.
Figure 5:
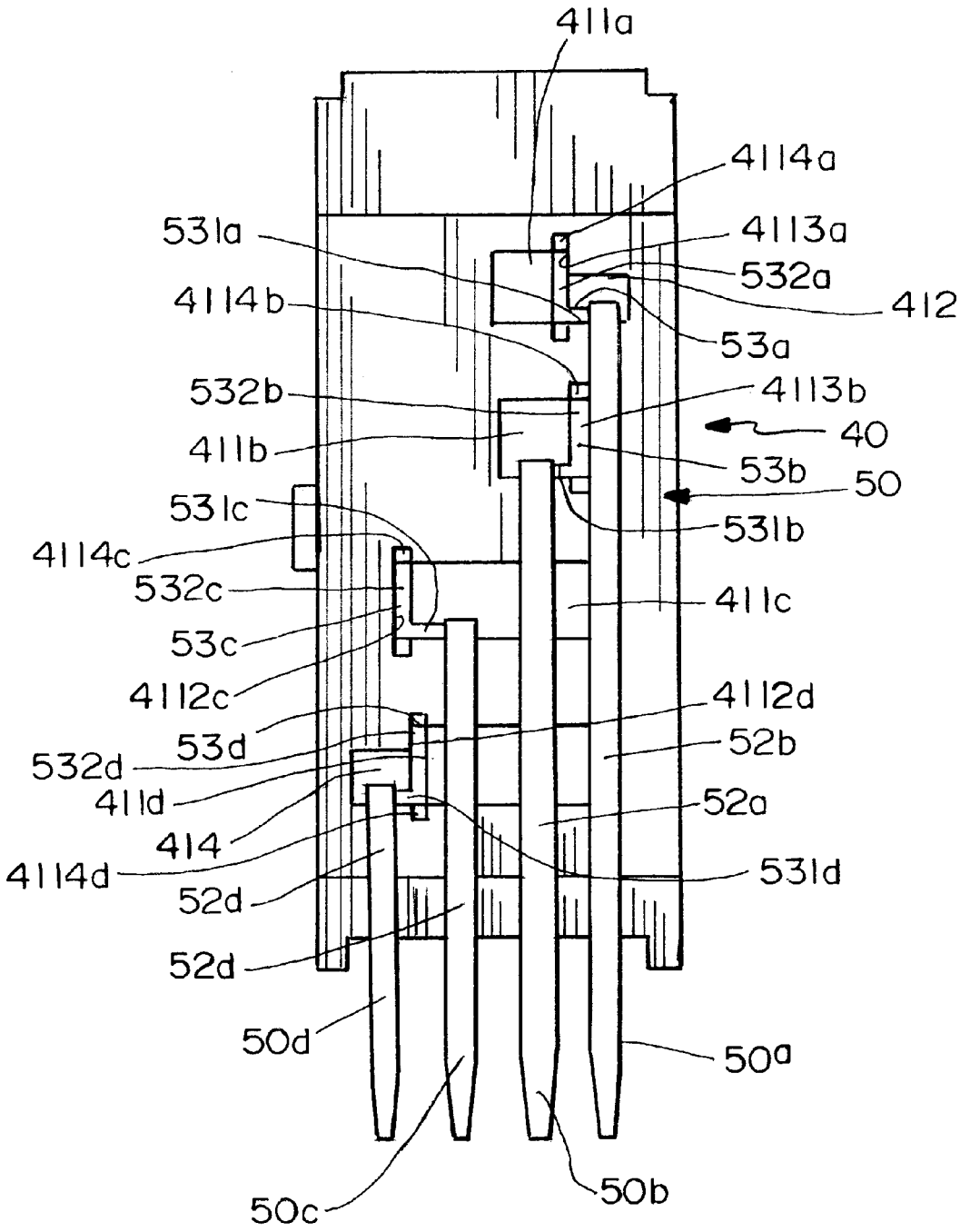
FIG. 5 is a rear schematic view illustrating how terminals are mounted on the terminal housing of FIG. 4 according to this invention.

The back plate 41 is formed with a plurality of terminal openings 411. In the first embodiment, there are four terminal openings 411*a*, 411*b*, 411*c*, 411*d*. As generally shown in FIG. 4, each terminal opening is confined by upper and lower walls 4110, 4111, and left and right side walls 4112, 4113. The upper and lower walls 4110, 4111 are longer than the left and right side walls 4112, 4113. The walls 4110, 4111, 4112, 4113 of each terminal opening 411*a*, 411*b*, 411*c*, 411*d* are distinguished from the walls of other terminals in the Figures by attaching the corresponding suffix a, b, c, d. The upper two of the terminal openings 411*a*, 411*b* are shorter than the lower two of the terminal openings 411*c*, 411*d*. The lower wall 4111*a* of upper terminal opening 411*a* is extended into an auxiliary opening 412 formed in the right wall 4113*a*. The lower wall 4111*d* of lower terminal opening 411*d* is extended into an auxiliary opening 414 formed in the left wall 4112*d*. Each of the terminal openings 411*a*, 411*b*, 411*c*, 411*d* includes a retention slot 4114*a*, 4114*b*, 4114*c*, 4114*d* comprising opposed notches at a respective side of the opening. The retention slots 4114*a*, 4114*b* in terminal openings 411*a*, 411*b* are disposed on the right walls 4113*a*, 4113*b* and the retention slots 4114*c*, 4114*d* in terminal openings 411*c*, 411*d* are disposed on the left walls 4112*c*, 4112*d*.

The terminal support plate 43 is disposed on one side of the terminal opening 411*a*, 411*b*, 411*c*, 411*d* and is provided with a plurality of horizontally extending terminal cavities 431 that are vertically arrayed and preferably vertically aligned. The terminal cavities 431 are normal to the back plate 41. In the first embodiment, there are four terminal cavities 431 that correspond respectively to the terminal openings 411*a*, 411*b*, 411*c*, 411*d*. The retention slots 4114*c*, 4114*d* in terminal openings 411*c*, 411*d* are offset from and, therefore, are not disposed in the same plane as the terminal cavities 431.

In the first embodiment, there are four terminals 50*a*, 50*b*, 50*c*, 50*d* in the terminal set 50. Each terminal in the terminal set 50 is formed integrally by punching a conductive plate, and includes a vertical solder tail portion 52*a*, 52*b*, 52*c*, 52*d* retained in a respective one of the notches 421 of the tail aligning plate 42, a horizontal terminal mating portion 51 received in a respective one of the terminal cavities 431 in the terminal support plate 43, and a retention portion 53*a*, 53*b*, 53*c*, 53*d* between the respective solder tail portion 52*a*, 52*b*, 52*c*, 52*d* and the terminal mating portion 51 and engaging the back plate 41 in a respective one of the terminal openings 411*a*, 411*b*, 411*c*, 411*d*. Retention portions 53*a*, 53*b*, 53*c*, 53*d* preferably include barbs 534 for engaging retention slots 4114 in respective terminal openings 411*a*, 411*b*, 411*c*, 411*d*.

The solder tail portions 52*a*, 52*b*, 52*c*, 52*d* of the terminals 50*a*, 50*b*, 50*c*, 50*d* have varying lengths. The solder tail portion 52*a* of the terminal 50*a* with the retention portion 53*a* thereof retained in the uppermost terminal opening 411*a* has the longest length, while the solder tail portion 52*d* of the terminal 50*d* with the retention portion 53*d* thereof retained in the lowermost terminal opening 411*d* has the shortest length. The free ends of the solder tail portions 52*a*, 52*b*, 52*c*, 52*d* are flush with each other.

The retention portion 53*a*, 53*b*, 53*c*, 53*d* of each terminal 50*a*, 50*b*, 50*c*, 50*d* includes a horizontal plate section 531*a*, 531*b*, 531*c*, 531*d* that abuts against the lower wall 4111*a*, 4111*b*, 4111*c*, 4111*d* of the respective terminal opening 411*a*, 411*b*, 411*c*, 411*d*. The horizontal plate 531*a* section of the upper terminal 50*a* is disposed in auxiliary opening 412, and the horizontal plate section 531*d* of lower terminal 50*d* is disposed in auxiliary opening 414. A vertical plate section 532*a*, 532*b*, 532*c*, 532*d* extends from the respective horizontal plate section 531*a*, 531*b*, 531*c*, 531*d* between the upper and lower walls 4110, 4111 of the respective terminal opening 411*a*, 411*b*, 411*c*, 411*d* to firmly retain the respective retention portion 53*a*, 53*b*, 53*c*, 53*d* in the respective terminal opening 411*a*, 411*b*, 411*c*, 411*d*. Preferably, the vertical plate sections 532*a*, 532*b* of terminals 50*a*, 50*b* abut against the right side walls 4113*a*, 4113*b* of terminal openings 411*a*, 411*b*, respectively, and the vertical plate sections 532*c*, 532*d* of terminals 50*c*, 50*d* abut against the left side walls 4112*c*, 4112*d* of terminal openings 411*c*, 411*d*, respectively. In other words, the vertical plate sections 532*a*, 532*b*, 532*c*, 532*d* abut against the side wall of the respective terminal opening 411*a*, 411*b*, 411*c*, 411*d* on which the retention slots 4114 are provided. The solder tail portion 52*a*, 52*b*, 52*c*, 52*d* of each terminal 50*a*, 50*b*, 50*c*, 50*d* has a top edge connected to the rear edge of the respective horizontal plate section 531*a*, 531*b*, 531*c*, 531*d*. Each terminal mating portion 51 has a rear edge connected to the front edge of the vertical plate section 532*a*, 532*b*, 532*c*, 532*d*.

The terminal mating portion 51 of each terminal 50*a*, 50*b*, 50*c*, 50*d* includes a bent resilient contact strip 511 that projects relative to the terminal support plate 43 for enhanced contact with a pin of a corresponding plug connector (not shown). Since the retention portions 53*c*, 53*d* of the terminals 50*c*, 50*d* are offset from the terminal support plate 43, the terminal mating portion 51 of the same further includes an offset extension 54*c*, 54*d* that is normal to the terminal support plate 43 and that interconnects the retention portion 53*c*, 53*d* and the resilient contact strip 511, thereby compensating for the horizontal space between the section with barbs 534 of the retention portion 53*c*, 53*d* disposed in retention slots 4114*c*, 4114*d* and the terminal mating portions 51 disposed in respective terminal cavity 431.

Figure 6:
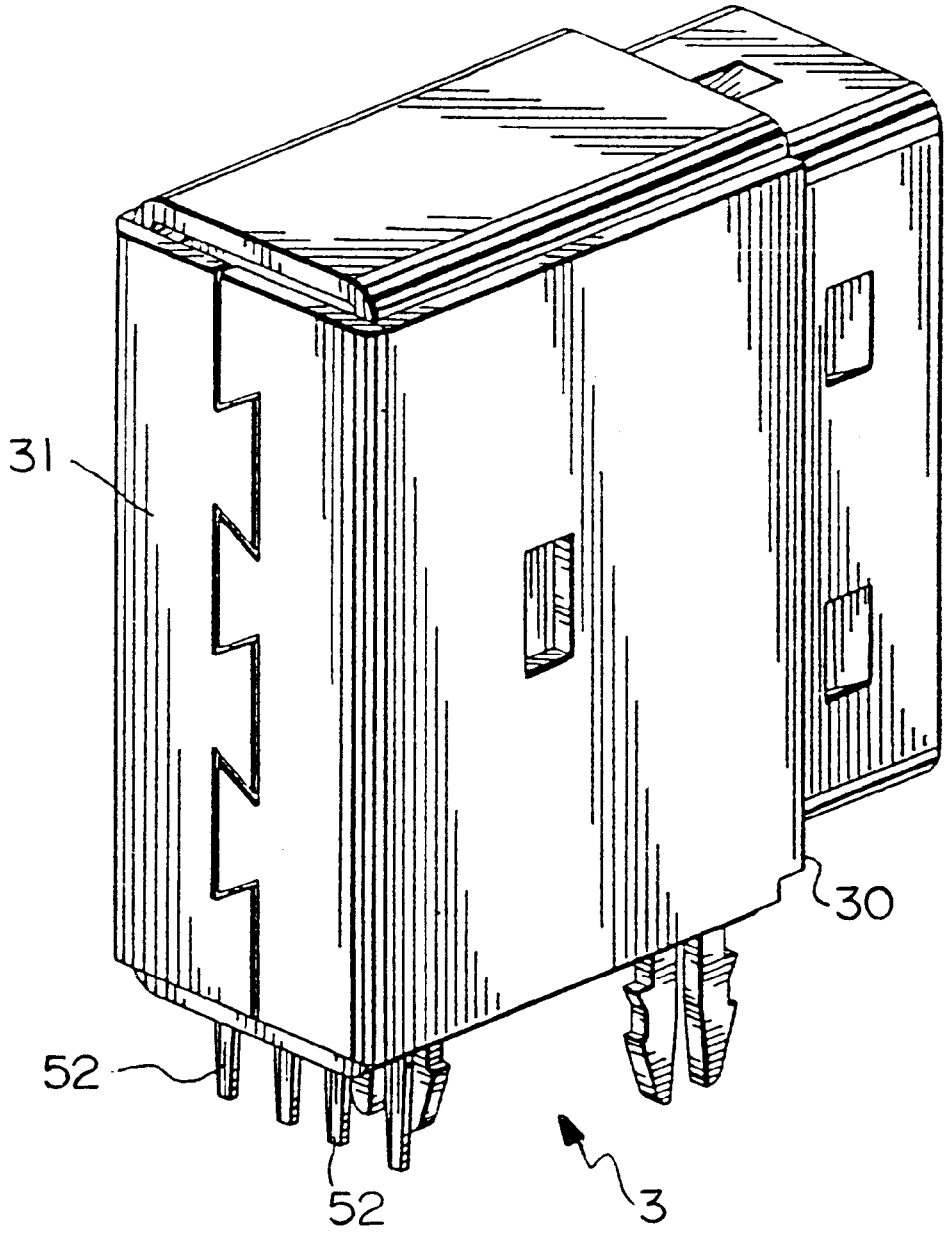
FIG. 6 is an assembled rear perspective view of the first preferred embodiment.

Preferably, the shell 30 is provided with a cover unit 31 to close the rear end of the same (see FIG. 6).

Figure 7:
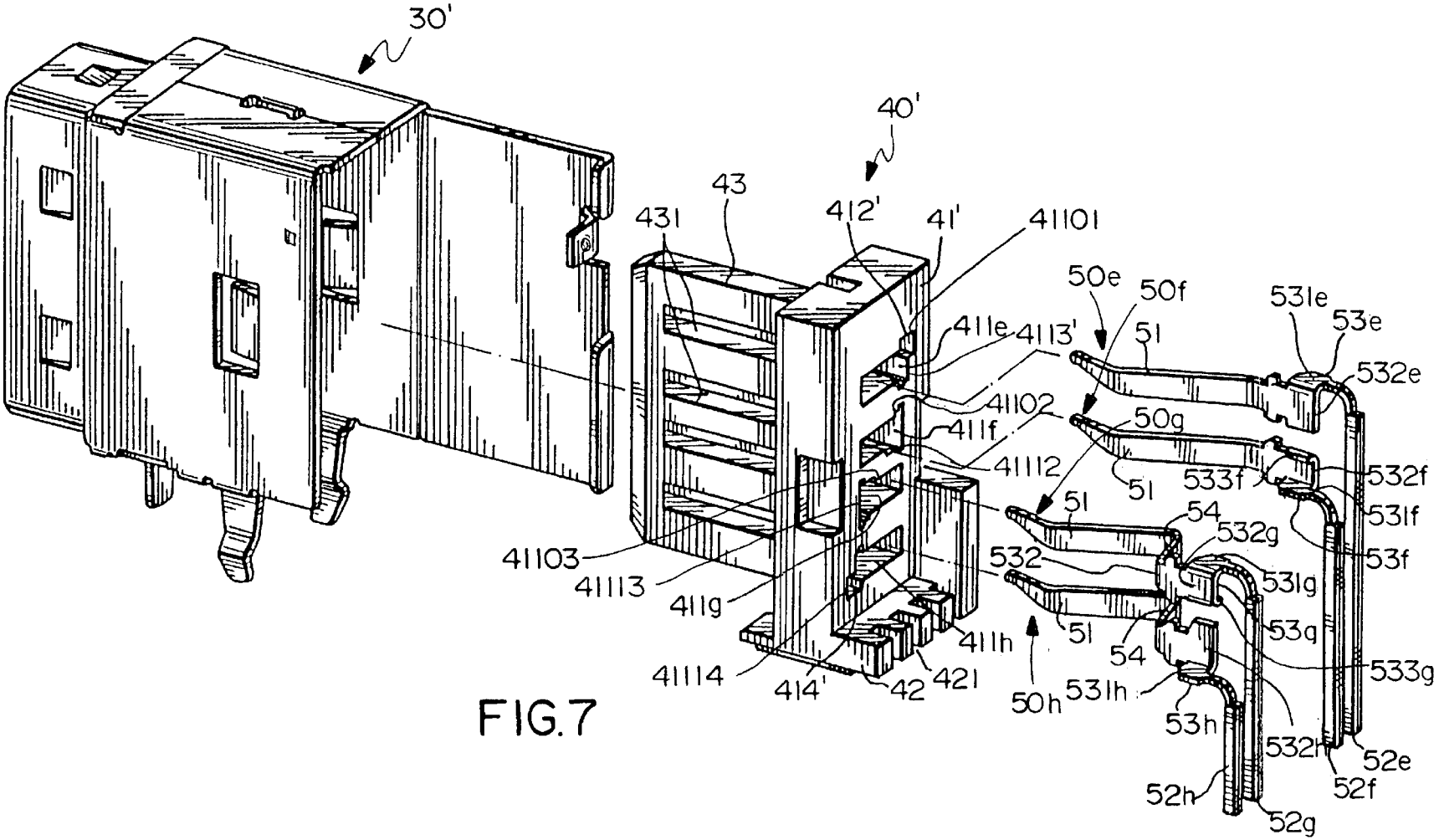
FIG. 7 is an exploded perspective view of the second preferred embodiment of a vertical-type electrical connector according to this invention.
Figure 8:
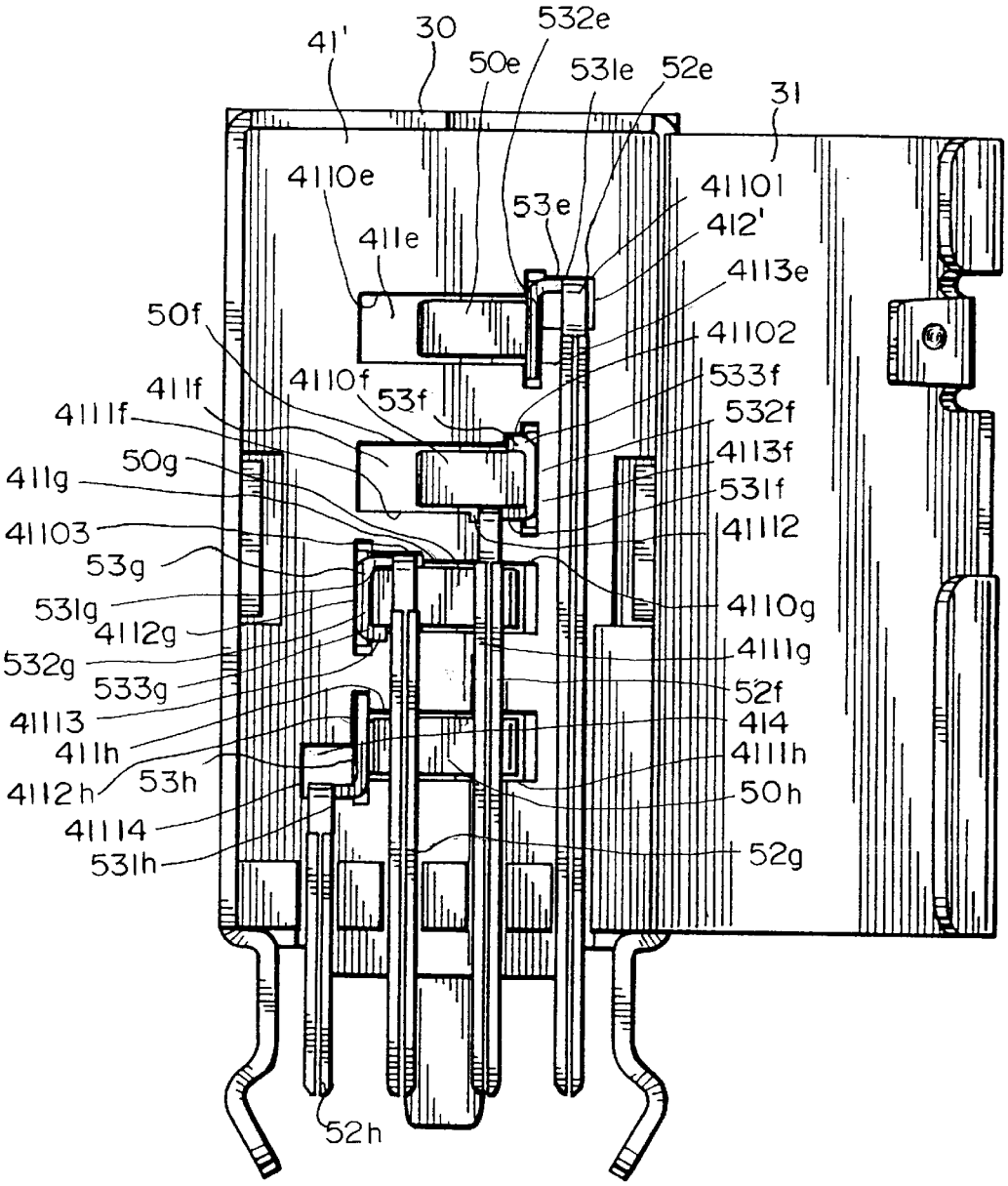
FIG. 8 is a rear schematic view illustrating how terminals are mounted on the terminal housing according to the second embodiment.
Figure 9:
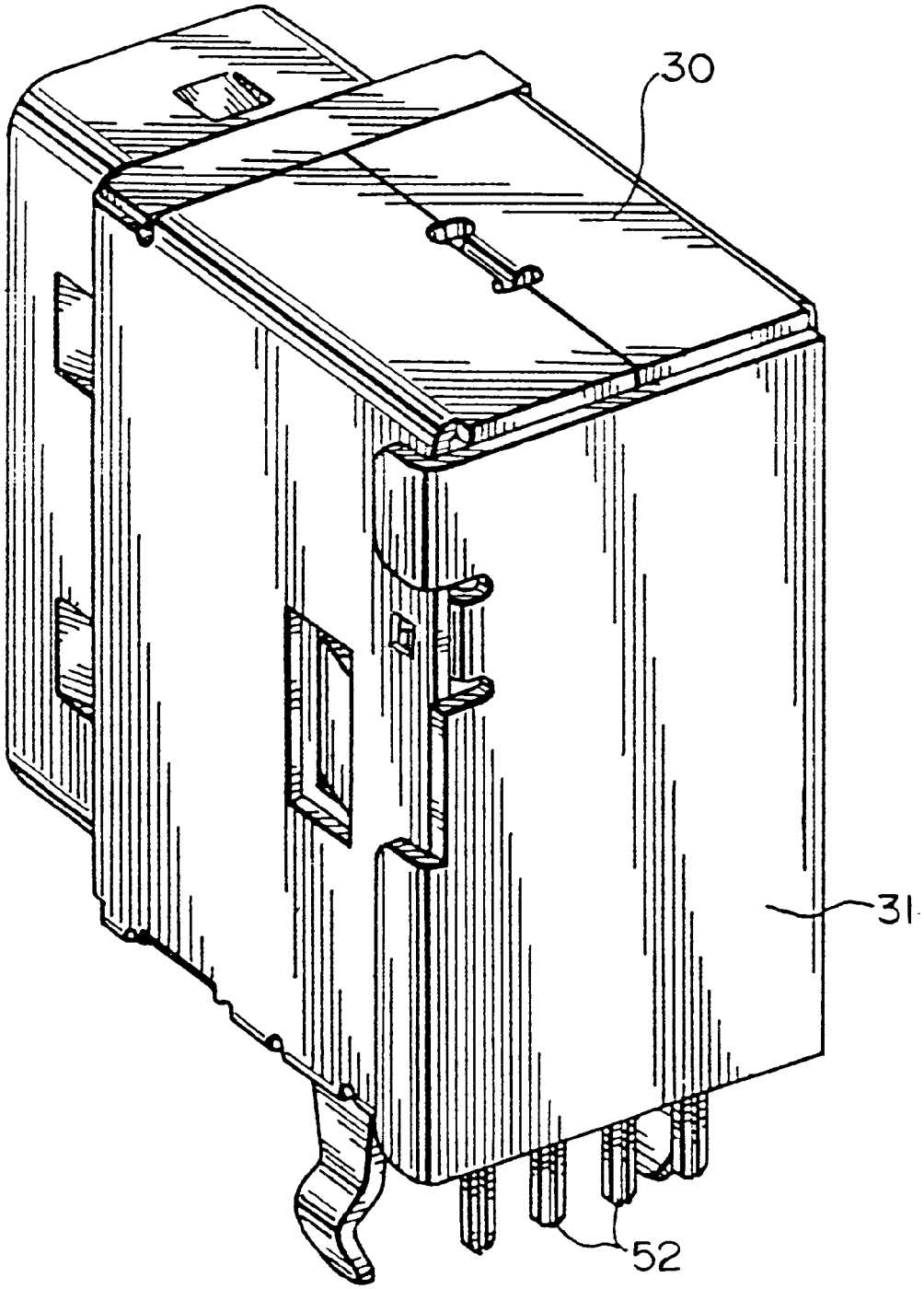
FIG. 9 is an assembled rear perspective view of the second preferred embodiment.

FIGS. 7, 8 and 9 illustrate the second preferred embodiment of a vertical-type electrical connector according to the present invention. The reference numerals used in FIG. 3–6 will be used in FIGS. 7–9 to designate like elements.

The main differences between the present embodiment and the preferred embodiment of FIGS. 3–6 reside in the configuration of the terminal openings 411*e*, 411*f*, 411*g*, 411*h* and in the arrangement of the retention portions 53*e*, 53*f*, 53*g*, 53*h* of the terminals 50*e*, 50*f*, 50*g*, 50*h*. As shown best in FIG. 8, the terminal openings 411*e*, 411*f*, 411*g*, 411*h* are vertically aligned and have a similar size and shape. The upper wall 4110*e* of the uppermost terminal opening 411*e* extends into an auxiliary opening 412' formed in the right wall 4113*e*. The lower wall 4111*h* of the lowermost terminal opening 411*h* extends into an auxiliary opening 414' formed in the left wall 4112*h*. A recess 41101 is formed in the upper wall 4110*e* in auxiliary opening 412', and a recess 41104 is formed in the lower wall 4111*h* in auxiliary opening 414'. The horizontal plate section 531*e*, 531*h* of the retention portion 53*e*, 53*h* of the respective corresponding terminal 50*e*, 50*h* abuts against respective recesses 41101, 41114 in upper wall 4110*e* and lower wall 4111*h*, respectively, in respective auxiliary openings 412', 414'. The horizontal plate sections 531*f*, 531*g* of the retention portions 53*f*, 53*g* of the terminals 50*f*, 50*g* abut against respective recesses 41112, 41103 in the lower wall 4111*f* and upper wall 4111*h*, respectively, of the respective terminal opening 411*f*, 411*h*.

The horizontal plate sections 531*e*, 531*g* of the retention portions 53*e*, 53*g* of the terminals 50*e*, 50*g* abut against respective recesses 41101, 41103 in the respective upper wall 4110*e*, 4110*g* of the respective terminal opening 411*e*, 411*g*. The vertical plate sections 532*e*, 532*f* of terminals 50*e*, 50*f* abut against the respective right side wall 4113*e*, 4113*f* of the respective terminal opening 411*e*, 411*f*. The vertical plate sections 532*g*, 532*h* of terminals 50*g*, 50*h* abut against the respective left side wall 4112*g*, 4112*h* of the respective terminal opening 411*g*, 411*h*. The retention portions 53*f*, 53*g* of the terminals 50*f*, 50*g* are further provided with a second horizontal plate section 533*f*, 533*g* that extends from the vertical plate section 532*f*, 532*g* and that abuts against a respective recess 41102, 41113 in the upper wall 4110*f* and lower wall 4111*g*, respectively, of the respective terminal opening 411*f*, 411*g* to increase the contact area between the back plate 41' and the retention portions 53*f*, 53*g* for securely mounting the terminals 50*f*, 50*g* on the terminal housing 40'.

Because the solder tail portions 52 of the conductive terminals 50 form a single row parallel to the back plate 41 of the terminal housing 40, the electrical connector of this invention has a shorter length in the longitudinal direction (a length of about 14 mm), thereby occupying less real estate on a circuit board in the longitudinal direction than if the solder tail portions were arranged perpendicular to the back plate.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical connector comprising:

a terminal housing including a body having a front surface and a back surface formed with a plurality of terminal openings, a terminal support plate extending forwardly from the front surface of said body and being provided with a plurality of horizontally extending terminal cavities that are vertically arrayed and that are generally normal to the front surface of said body, said terminal cavities corresponding respectively to said terminal openings, and a tail aligning plate extending rearwardly from the back surface of said body and being provided with a plurality of notches that form a horizontal array parallel to the back surface of said body; and a plurality of terminals, each of which includes a vertical solder tail portion retained in a respective one of said notches, a horizontal terminal mating portion received in a respective one of said terminal cavities, and a retention portion between said solder tail portion and said terminal mating portion and engaging said body in a respective one of said terminal openings, said retention portion including a vertical plate section abutting against a side wall of a respective one of said openings.

2. The electrical connector of claim 1, wherein said terminal openings are rectangular in shape and are confined by upper and lower walls and left and right side walls, the upper and lower walls being longer than said left and right side walls.

3. The electrical connector of claim 2, wherein said retention portion of at least one of said terminals includes a first horizontal plate section abutting against one of said upper and lower walls of the respective one of said terminals openings, and a vertical plate section extending from the first horizontal plate section between said upper and lower walls of the respective one of said terminal openings.

4. The electrical connector of claim 3, wherein said vertical plate section abuts against one of said left and right side walls of the respective one of said terminal openings.

5. The electrical connector of claim 3, wherein said retention portion of at least one of said terminals further includes a second horizontal plate section extending from said vertical plate section and abutting against the other one of said upper and lower walls of the respective one of said terminal openings.

6. The electrical connector of claim 3, wherein said solder tail portion has a top edge connected to a rear edge of said first horizontal plate section, and said terminal mating portion has a rear edge connected to a front edge of said vertical plate section.

7. The electrical connector of claim 2, wherein said terminal housing is formed integrally from an insulator material.

8. The electrical connector of claim 1, wherein each of said terminals is formed integrally by punching a conductive plate.

9. The electrical connector of claim 1, wherein said terminal mating portion includes a bent resilient contact strip that projects relative to said terminal support plate.

10. The electrical connector of claim 9, wherein said terminal mating portion of at least one of said terminals having said retention portion thereof offset from said terminal support plate further includes an offset extension that is normal to said terminal support plate and that interconnects said retention portion and said resilient contact strip.

11. The electrical connector of claim 1, wherein said terminal cavities are vertically aligned.

12. A conductive terminal for an electrical connector, comprising a vertical solder tail portion, a horizontal terminal mating portion, and a retention portion between said solder tail portion and said terminal mating portion, said retention portion including a first horizontal plate section and a vertical plate section extending from the first horizontal plate section, said solder tail portion having a top edge connected to a rear edge of said first horizontal plate section, said terminal mating portion having a rear edge connected to a front edge of said vertical plate section.

13. The conductive terminal of claim 12, wherein said retention portion further includes a second horizontal plate extending from said vertical plate section.

14. The conductive terminal of claim 12, wherein said terminal is formed integrally by punching a conductive plate.

15. The conductive terminal of claim 12, wherein said terminal mating portion includes a bent resilient contact strip.

16. The conductive terminal of claim 15, wherein said terminal mating portion further includes an offset extension that interconnects said retention portion and said resilient contact strip.

17. An electrical connector comprising:

a terminal housing including:

a vertical back plate formed with a plurality of terminal openings, a vertical terminal support plate extending forwardly from said back plate on one side of said terminal openings and being provided with a plurality of horizontally extending terminal cavities that are vertically aligned and that are normal to said back plate, said terminal cavities corresponding respectively to said terminal openings, and a horizontal tail aligning plate extending rearwardly from said back plate and being provided with a plurality of notches that form a single row parallel to said back plate; and a plurality of terminals, each of which includes a vertical solder tail portion retained in a respective one of said notches together forming a single row of vertical solder tail portions that is parallel to said back plate, a horizontal terminal mating portion received in a respective one of said terminal cavities together forming a vertically aligned plurality of terminal mating portions, and a retention portion between said solder tail portion and said terminal mating portion and engaging said back plate in a respective one of said terminal openings.

* * * * *